US005800089A

United States Patent [19]

Donaton

[11] Patent Number: 5,800,089

[45] Date of Patent: Sep. 1, 1998

[54] ADJUSTABLE DETACHABLE POOL COVER ANCHOR

[76] Inventor: William S. Donaton, 100 Engineers Rd., Hauppauge, N.Y. 11788

[21] Appl. No.: 657,318

[22] Filed: Jun. 3, 1996

[51] Int. Cl.[6] ..... E04H 4/14

[52] U.S. Cl. ..... 403/393; 403/4; 403/109; 403/DIG. 9

[58] Field of Search ..... 4/503, 504, 498; 403/104, 107, 109, 393, 4, DIG. 9; 24/704.1, 562, 580

[56] References Cited

U.S. PATENT DOCUMENTS

| | | | |
|---|---|---|---|
| 42,651 | 5/1864 | Tinkelpaugh | 403/107 X |
| 275,303 | 4/1883 | Werneth | 403/107 X |
| D. 359,224 | 9/1995 | Airey | D8/349 |
| 1,961,935 | 6/1934 | Knapp | 248/18 |
| 2,247,846 | 7/1941 | Perlman . | |
| 2,815,809 | 12/1957 | Jacobs et al. | 160/368 |
| 2,914,776 | 12/1959 | Hotz | 4/172 |
| 2,958,872 | 11/1960 | Meyer | 4/172 |
| 3,229,309 | 1/1966 | Knodel | 4/503 |
| 3,264,656 | 8/1966 | Clay et al. | 4/172 |
| 3,360,075 | 12/1967 | Gutner | 182/106 |
| 3,373,464 | 3/1968 | Ansnit | 24/201 |
| 3,600,721 | 8/1971 | Pusey | 4/172.12 |
| 3,711,873 | 1/1973 | Katzman | 4/172.12 |
| 3,780,385 | 12/1973 | Dunn | 4/172.12 |
| 3,803,671 | 4/1974 | Stuppy et al. | 24/243 K |
| 3,982,286 | 9/1976 | Foster | 4/172.14 |
| 3,987,835 | 10/1976 | Bloomfield | 160/392 |
| 4,001,900 | 1/1977 | Lamb | 4/172.14 |
| 4,011,607 | 3/1977 | Davidoff | 4/172.12 |
| 4,047,353 | 9/1977 | Aarons | 403/107 X |
| 4,080,690 | 3/1978 | Vaux | 24/201 |
| 4,094,021 | 6/1978 | Rapp | 4/503 |
| 4,151,617 | 5/1979 | Kinzel | 4/172.14 |
| 4,164,047 | 8/1979 | Barothy | 4/172.11 |
| 4,195,622 | 4/1980 | Dolza et al. | 126/415 |
| 4,387,873 | 6/1983 | Pavlo | 248/226.4 |
| 4,466,144 | 8/1984 | Lamb | 4/503 |
| 4,677,352 | 6/1987 | Leister | 4/498 |
| 4,716,603 | 1/1988 | Sernetz | 4/501 |
| 4,790,293 | 12/1988 | Caines | 126/415 |
| 4,951,327 | 8/1990 | Del Gorio, Sr. | 4/498 |
| 4,953,239 | 9/1990 | Gadsby | 4/499 |
| 4,982,457 | 1/1991 | Donaton | 4/504 |
| 5,065,461 | 11/1991 | Shehan et al. | 4/503 |
| 5,067,184 | 11/1991 | Last | 4/502 |
| 5,067,213 | 11/1991 | Ragsdale | 24/704.1 |
| 5,068,929 | 12/1991 | Weiner | 4/503 |
| 5,095,557 | 3/1992 | Keyes | 4/503 |
| 5,107,551 | 4/1992 | Weir et al. | 4/496 |
| 5,184,377 | 2/1993 | Ragsdale | 24/704.1 |
| 5,259,077 | 11/1993 | Hager et al. | 4/498 |
| 5,282,282 | 2/1994 | Shehan et al. | 4/503 |
| 5,303,527 | 4/1994 | Perez | 52/632 |
| 5,327,590 | 7/1994 | Last | 4/502 |
| 5,371,907 | 12/1994 | Horvath | 4/498 |
| 5,417,016 | 5/1995 | Dahowski | 52/23 |
| 5,421,041 | 6/1995 | Stern | 4/498 |
| 5,426,899 | 6/1995 | Jones | 52/63 |
| 5,450,635 | 9/1995 | Coffey | 4/498 |
| 5,516,386 | 5/1996 | Savarese | 156/210 |

*Primary Examiner*—Anthony Knight
*Attorney, Agent, or Firm*—Alfred M. Walker

[57] ABSTRACT

A detachable anchor for a pool cover includes a two piece C-shaped body which fits over and engages a metal pool frame. The anchor is detached when the pool cover is removed. The anchor includes an anchor knob which engages the loop of a spring-loaded attachment mechanism attached to a swimming pool cover. The anchor is adjustable for different sized pool frames, so that the same anchor can be used for different pool frame sizes. The adjustable detachable pool cover anchor accommodates a wide variety of pool frame sizes.

10 Claims, 7 Drawing Sheets

Fig. 3
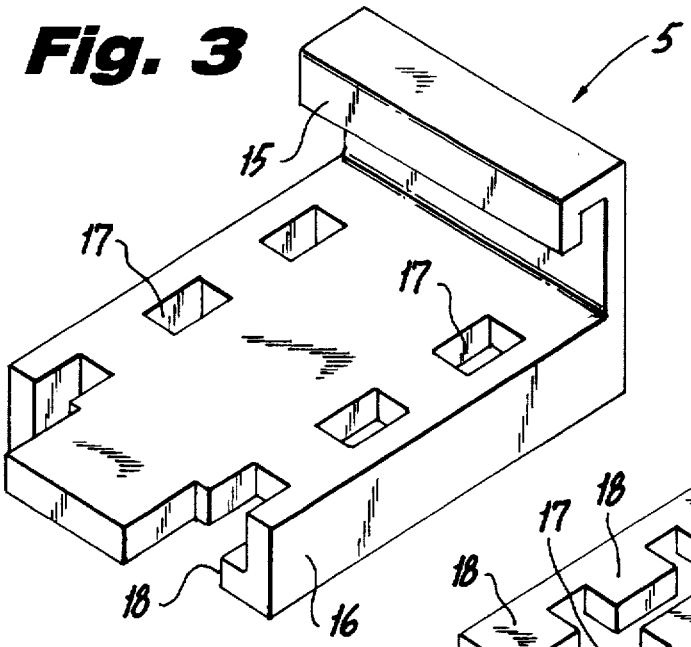
Fig. 4
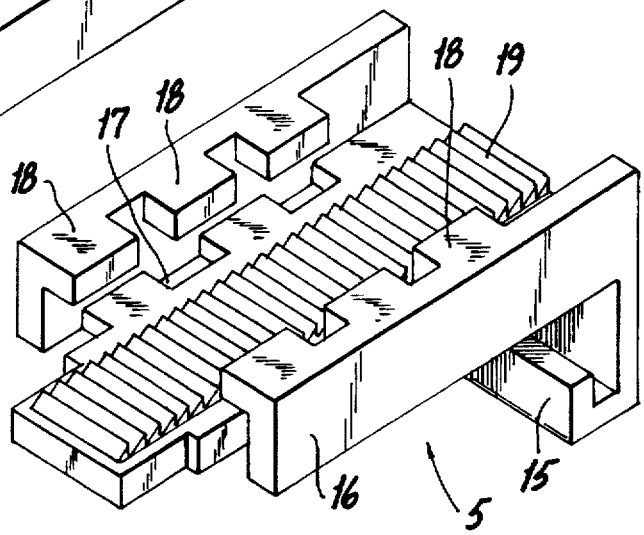
Fig. 5
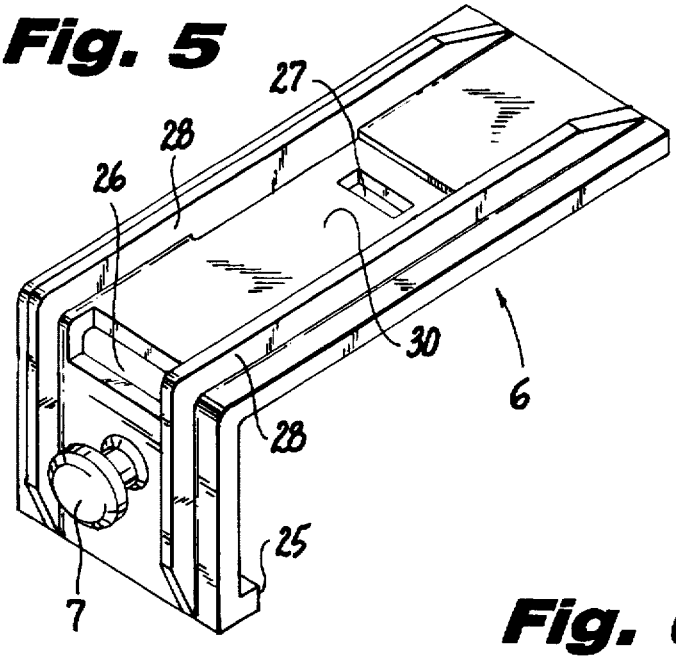
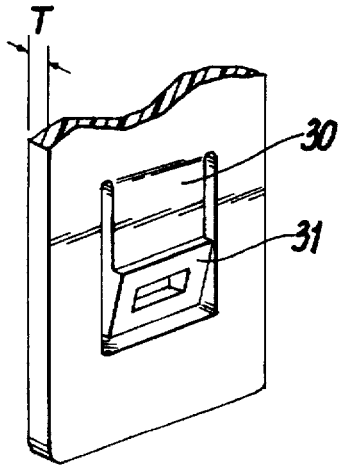
Fig. 6

ADJUSTABLE DETACHABLE POOL COVER ANCHOR

FIELD OF THE INVENTION

The present invention relates to attachments for swimming pool covers.

BACKGROUND OF THE INVENTION

Various attempts have been made to attach a swimming pool cover to a swimming pool frame. For example, U.S. Design Pat. No. 359,224 of Airey describes a non-adjustable detachable anchor for a pool cover for an above ground pool having a circumferential pool frame. The commercial version of this device has a body cut from a section of aluminum extrusion. This forms the anchor which fits over and engages the metal pool frame. Tension from a spring-loaded attachment to the pool cover keeps the anchor in place during use. The anchor is detached when the pool cover is removed. The anchor of this design consists of the body mentioned above swaged to a metal turning which comprises the anchor knob which engages the loop of the spring-loaded attachment mechanism. Thus, the prior art device is made of two parts which are mechanically attached, and then the assembly is painted.

The major limitation of this device is that it is not adjustable for different sized pool frames. A different part number of anchor must be used for each different pool frame size.

Other fasteners for various pool covers include snap hooks, which have been used to attach pool covers to an eye bolt at the edge of a pool wall, such as described in Applicant's pending application filed on Jul. 3, 1995 under Ser. No. 08/497,813 for a fastener used in conjunction with a pool cover having an attached "Safedge®" flexible seal device, to prevent the falling of persons between the pool cover and the pool wall, such as described in Applicant's prior U.S. Pat. No. 4,982,457.

U.S. Pat. No. 1,961,931 of Knapp describes a bracket for supporting a shelf therefrom. U.S. Pat. No. 3,360,075 of Gutner describes an adjustable C-shaped bracket for supporting a bed ladder to a double decker bedframe.

U.S. Pat. No. 3,264,656 of Clay et al. describes a swimming pool cover attachment including an embedded shaft with a knob accommodating a loop fastener attached to a pool cover. The anchor is embedded within a swimming pool deck.

Other background art for adjustable fasteners for swimming pool covers lack structural integrity. For example, U.S. Pat. No. 4,151,617 of Kinzel shows a swimming pool cover attached only by suction cups 18, as in FIG. 2 therein. Furthermore, U.S. Pat. No. 4,387,873 of Pavlo et al. describes a hook which is adjustable lengthwise by hook and loop VELCRO® fasteners, which lack rigor and structural integrity to hold a taut, heavy swimming pool cover.

U.S. Pat. No. 4,716,603 of Sernetz also shows a swimming pool cover, which is anchored by cords 26 which pass through eyelets 5 in the cover.

U.S. Pat. No. 4,790,293 of Caines describes an apparatus and method for solar heating of water, wherein a cover is attached by a clamp, but does not describe the structure of the clamp.

U.S. Pat. No. 4,951,327 of Del Gorio describes a cylindrical pool cover support system having a non-adjustable C-shaped bracket which engages a pool frame lip, wherein further the cover drapes over radial arms extending from a central post to the C-shaped brackets.

U.S. Pat. No. 4,953,239 of Gadsby shows an inflatable pool cover attached by grommets 26 as in the drawings.

U.S. Pat. Nos. 5,065,461 and 5,282,282 both of Shehan describe a swimming pool and cover, wherein the cover is attached to the vertical pool wall by releasable, two-component fasteners 26, such as hook and loop VELCRO® fasteners or DUO-LOC® fasteners, which lack structural integrity to support taut, heavy swimming pool covers.

U.S. Patent Nos. 5,067,213 and 5,184,377, both of Radsdale describe a swimming pool anchor and removal tool, wherein a swimming pool cover is attached by a stake member 10 insertable through an eyelet 70 of the pool cover 28 and into a channel 38 dug into a pool deck 30.

U.S. Pat. No. 5,068,929 of Weiner describes an edge retainer for a floating pool cover, wherein the cover is attached by a loose ball and shank fastener insertable within a notch of a bracket extending from the pool wall.

U.S. Pat. No. 5,107,551 of Weir describes a non-adjustable multiple accessory swimming pool coping member having grooves for insertion of beads attached to the pool cover therein.

U.S. Pat. No. 5,259,077 of Hager describes a swimming pool cover elevation device having C-shaped hooks engagable over an above ground pool frame. The C-shaped hooks are attached to a central post by radial arms of rope, which include wrapping members to adjust the length of the rope.

U.S. Pat. No. 5,303,527 of Perez describes a removable pool cover support apparatus, wherein the cover is held by a threaded rod insertable within a non-adjustable yoke and collar, like how a door is attached to a door frame.

U.S. Pat. No. 5,371,907 of Horvath describes a non-adjustable C-shaped fastener for a pool cover for a cylindrical above the ground pool, wherein the fastener is tightened by threaded fasteners.

U.S. Pat. No. 5,417,016 of Dahowski describes a molded plastic cover for stairwell openings contiguous to a swimming pool. The cover includes C-shaped openings for insertion of swimming pool cover edge beads therein.

U.S. Pat. No. 5,421,041 of Stern shows a pool coping protector, wherein the pool cover is attached by a tie down fastener to a pool deck.

Another fastener is described in U.S. Pat. No. 4,080,690 of Vaux, wherein a quick release fastener includes an eye or loop at one end and a smaller loop at an opposite end, wherein the smaller loop is at right angles to the plane of the larger eye or loop, and the smaller loop is insertable within a small groove at right angles to a slot within a body in which the smaller loop is inserted. Since the smaller loop fits only one position within the groove, the fastener in Coffey, 635 is non-adjustable lengthwise.

U.S. Pat. No. 5,450,635 of Coffey describes a C-shaped clamp for a swimming pool cover which is tightened by a traditional thumbscrew threaded into an end member of the C-shaped body. However, this lacks structural integrity, since the thumbscrew engages a smaller portion of a pool frame than the opposite end member of the C-shaped body. Moreover, the thumbscrew itself is subject to loosing by virtue of the axial threading of the thumbscrew.

Therefore, the prior art swimming pool cover fasteners are either non-adjustable, or are adjustable without providing structural integrity, as in Kinzel '617, Pavlo '873, Coffey '635, Shehan '461 and Shehan '282.

In contrast to the prior art, the present invention includes a lengthwise adjustable C-shaped clamp member used to attach a pool cover to the edge of an above ground pool. The member holds the edge of the pool cover horizontal and very close to the edge of the pool. The present invention optimally supports pool covers to any sized pool frames, with structural integrity, in the correct position at the edge of the pool cover.

OBJECTS OF THE INVENTION

An object of this invention is to provide an adjustable detachable pool cover anchor that accommodates a wide variety of pool frame sizes.

It is also an object of the present invention to provide an anchor which maintains structural integrity while being adjustable in length.

A further object of this invention is to manufacture this anchor as an injection molded device to save cost in materials and labor content. This can be done economically because a single set of molds can be used to make a single type of anchor in high volume that will be used for pools of many different frame sizes.

It is also an object of the present invention to improve over the disadvantages of the prior art.

SUMMARY OF THE INVENTION

In keeping with these objects and others which may become apparent, the present invention includes an adjustable C-shaped anchor with a frame and an anchor knob thereon. The lengthwise dimensions of the anchor is adjustable and can be used with many pool frames of various dimensions. The anchor engages with the pool frame attached to pool decking, such as wood or metal, within a recess in pool frame. The anchor includes a housing containing a bottom hook member and a male anchor member with an integral anchor knob thereon. A tension attachment assembly includes a compression spring, an anchor loop member and a cover attachment loop, which attaches to a fabric loop which, likewise, is attached to a pool cover.

A female housing portion includes a bottom hook, male retaining tabs, sides and holes and the male anchor member which fits partially inside the female anchor portion.

A retaining means, such as a ratchet rack, provides adjustment of the lengthwise dimension of the anchor while retaining structural integrity of the anchor. To change lengthwise adjustment, a male snap tab mates with the ratchet rack. An edge of the male snap jumps from the rack step to step when the male anchor member is pushed into the female housing portion for adjustment. The snap tab is held in place by a spring member. An aperture, such as a rectangular opening, provides access to an insertion member, such as a screwdriver blade. The insertion member is used to relieve the pressure of the edge of the male tab on the teeth of the ratchet rack, to allow the male anchor member to be withdrawn from the female housing portion of the anchor, to remove the anchor from the swimming pool frame, after the swimming pool cover is removed.

A hole region at the corner of the male anchor member permits an extension of the ratchet rack to move into this region when adjusting the anchor to its smallest clamping position, such as for small pool frames.

The anchor fits over and engages the pool frame. Tension from the spring-loaded ratchet attachment to the pool cover keeps the anchor in place during use. The anchor is detached when the pool cover is removed. The anchor knob engages the loop of a spring-loaded attachment mechanism attachable to a swimming pool cover.

The anchor of the present invention is adjustable for different sized pool frames. Therefore, the detachable pool cover anchor accommodates a wide variety of pool frame sizes.

BRIEF DESCRIPTION OF THE DRAWINGS

The present invention can best be described in conjunction with the accompanying drawings, in which:

FIG. 3 is an isometric top view of the female housing portion of the anchor as in FIG. 2;

FIG. 4 is an isometric bottom view of the female housing portion of the anchor as in FIG. 2;

FIG. 5 is an isometric view of the male anchor member portion of the anchor as in FIG. 2;

FIG. 6 is an isometric detail of the ratchet snap portion of the anchor as in FIG. 2;

DETAILED DESCRIPTION OF THE PREFERRED EMBODIMENTS

Figure 1:
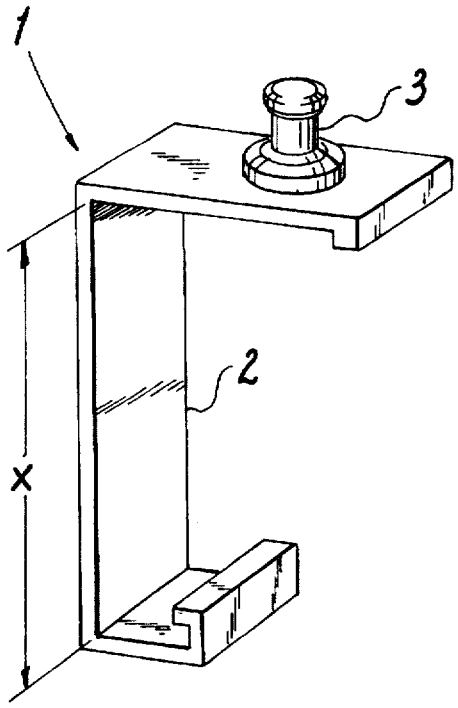
Fig. 1 (Prior Art)
FIG. 1 is a perspective view of a prior art anchor.

FIG. 1 shows a prior art anchor 1 with frame 2 and anchor knob 3. Dimension "x" is fixed and can only be used with a pool frame of compatible dimension.

Figure 2:
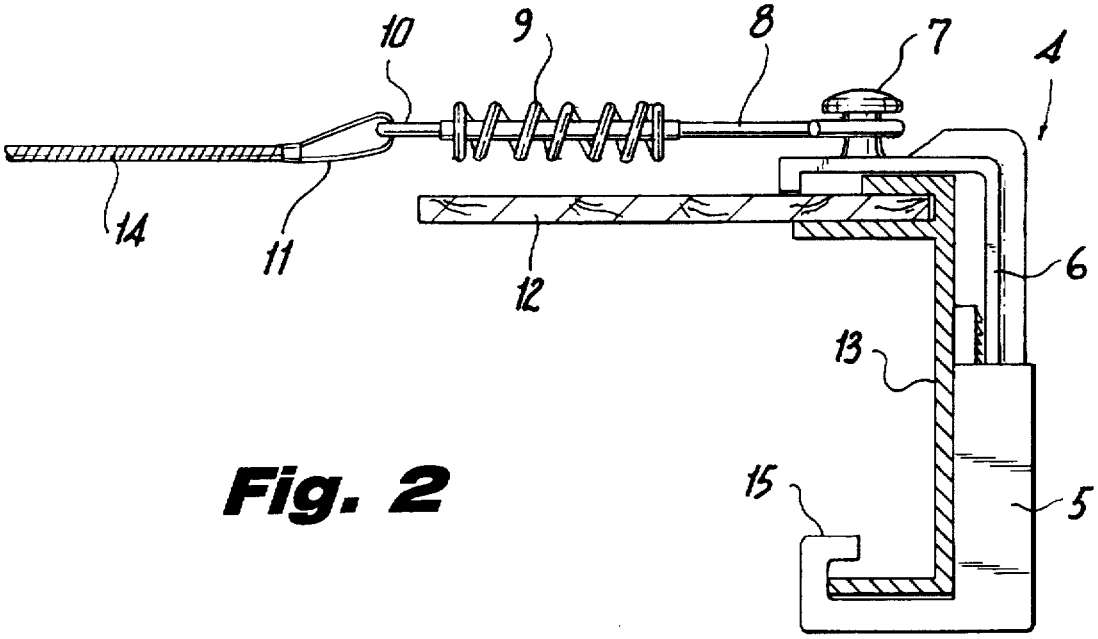
FIG. 2 is a side elevational view of the adjustable anchor of the present invention in use.
Figure 7:
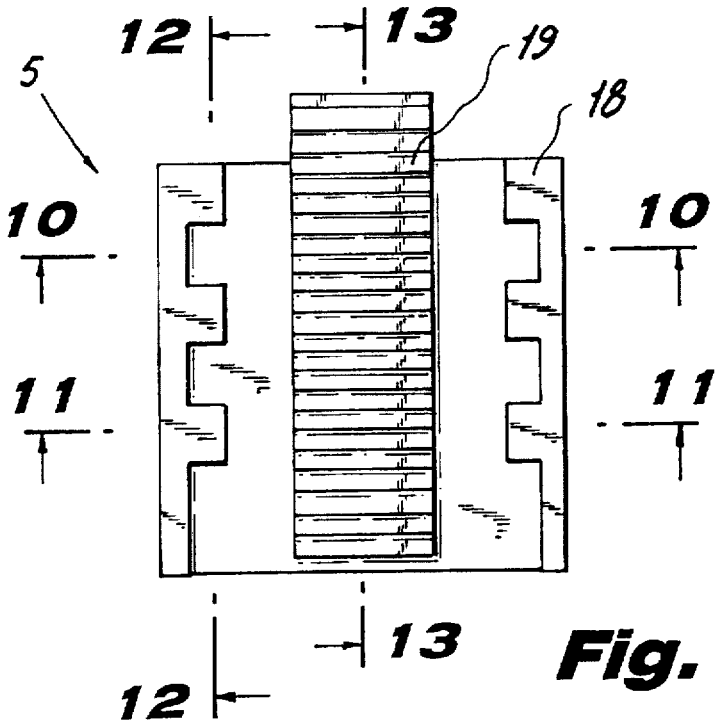
FIG. 7 is a front elevational view of the female housing portion of the anchor as in FIG. 2.
Figure 8:
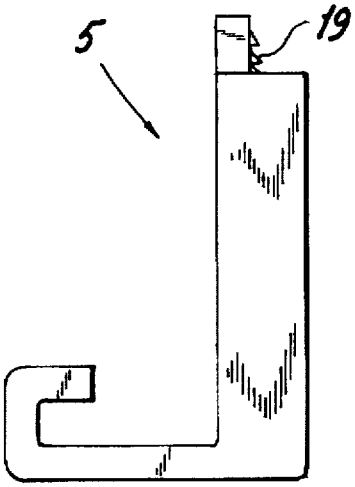
FIG. 8 is a side view of the female housing portion of the anchor as in FIG. 2.
Figure 9:
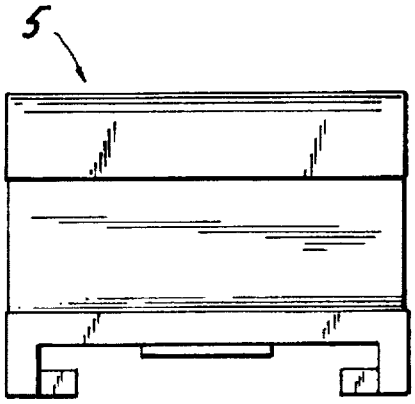
FIG. 9 is a bottom view of the female housing portion of the anchor as in FIG. 2.
Figure 10:
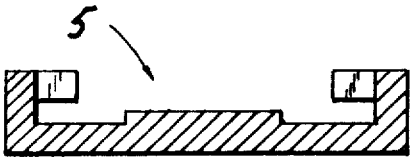
FIG. 10 is a rear cross section view of the female housing portion of the anchor as in FIG. 2.
Figure 11:
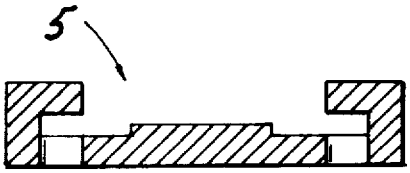
FIG. 11 is an alternate rear cross section view of the female housing portion of the anchor as in FIG. 2.
Figure 12:
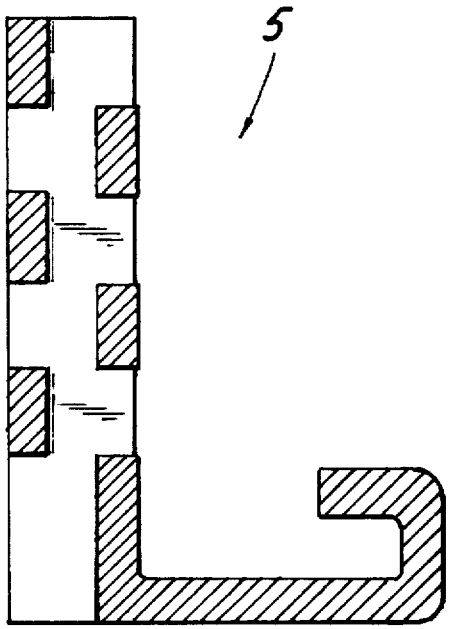
FIG. 12 is a side cross section view of the female housing portion of the anchor as in FIG. 2.

FIG. 2 shows a side view of the anchor 4 of this invention engaged with the pool frame 13 (shown in cross section).

The pool decking 12 which may be of wood or a variety of other materials is shown engaged in the recess provided for this purpose in pool frame 13. The anchor 4 consists of two major parts, namely, a first member, such as female housing portion 5 containing bottom hook member 15 and a second member, such as male anchor member 6 with anchor knob 7 integral with either said first member or said second member, such as male anchor member 6.

To achieve lengthwise adjustment of anchor 4, the first member, such as female housing portion 5, and the second member, such as male anchor member 6, are movable relative to each other. Preferably anchor 4 is generally C-shaped in configuration.

FIG. 2 also shows a tension attachment assembly including compression spring 9, anchor loop member 8 and cover attachment loop 10 is shown attached to fabric loop 11 which, in turn, is attached to pool cover 14.

FIG. 3 shows an isometric view of the female housing portion 5 with bottom hook 15, male retaining tabs 18, sides 16 and holes 17. This part as well as the male anchor member 6 which fits partially inside are injection molded of a rigid thermoplastic such as ABS, polycarbonate or nylon. A filled resin such as fiberglass filled nylon may give better performance because of increased strength and improved stiffness. The notching in male retaining tabs 18 as well as the holes 17 are features which are not functional but are related to the mold design and the movement of cores in the molding process. They also tend to reduce the amount of material required for this part.

Ratchet rack 19 facilitates the adjustment feature of the present invention. Anchor 4 includes an adjustment means permitting anchor 4 to accommodate a wide variety of pool frame sizes. The adjustment means includes a retaining member including a plurality of nesting positions for said first member relative to said second member.

To that end, FIG. 4 shows female housing portion 5 having ratchet rack 19, which ratchet rack 19 includes a plurality of teeth, wherein the teeth comprise a series of step by step adjustment locations. Male anchor member 6 has reinforcing ribs, and has snap tab 30 with edge 31 separately engagable with each tooth of the plurality of teeth of ratchet 19, wherein the plurality of teeth constitute a series of step by step adjustment locations for edge 31 of male snap tab 30 of male anchor member 6. Preferably, each tooth is angled at about 45 degrees up from a longitudinal lengthwise axis of female housing portion 5.

FIG. 5 is an isometric view of the male anchor member 6 with integral molded anchor knob 7 and reinforcing ribs 28. Surface 25 can rest on the pool decking in use.

FIG. 6 is a detail of the male snap tab 30, edge 31 of which male snap tab 30 mates with various teeth of ratchet rack 19 of female housing portion 5. Edge 31 jumps from each tooth of rack 19 step by step to an adjacent tooth when male anchor member 6 is pushed into housing 5 for adjustment. Male snap tab 30 forms a molded-in spring member for snap edge 31, and male snap tab 30 has a thinner section thickness than thickness "T" of male anchor member 6. The other side of male snap tab 30 is also shown in FIG. 5. Rectangular opening 27 provides access to a screwdriver blade which is used to relieve the pressure of edge 31 on ratchet rack 19 to permit the male anchor member 6 to be withdrawn from housing 5 to facilitate removal of the anchor from the pool frame after the pool cover is removed. The rectangular hole 26 at the corner of male anchor member 6 permits the extension of rack 19 to move into this region when adjusting the anchor 4 to its smallest clamping position (for small pool frames).

FIGS. 9 through 13 show a variety of views of the female housing part including several cross sections.

Figure 13:
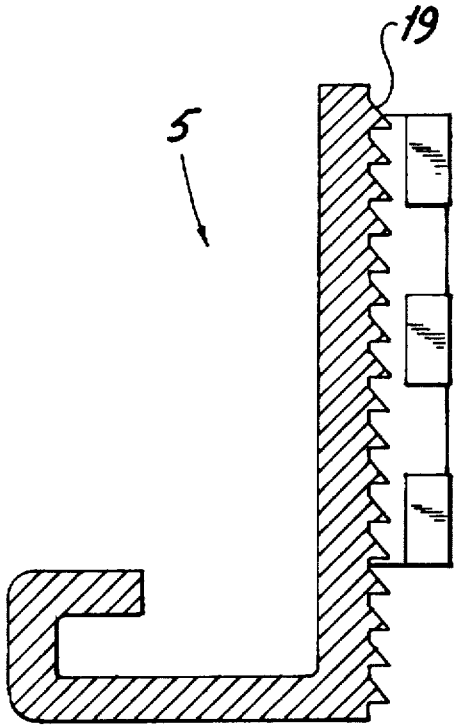
FIG. 13 is an alternate side cross section view of the female housing portion of the anchor as in FIG. 2.

In particular, FIG. 13 shows a side view of the ratchet rack 19 in cross section.

Figure 14:
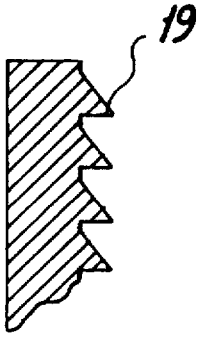
FIG. 14 is a side detail view of the ratchet rack portion of the anchor as in FIG. 2.
Figure 15A:
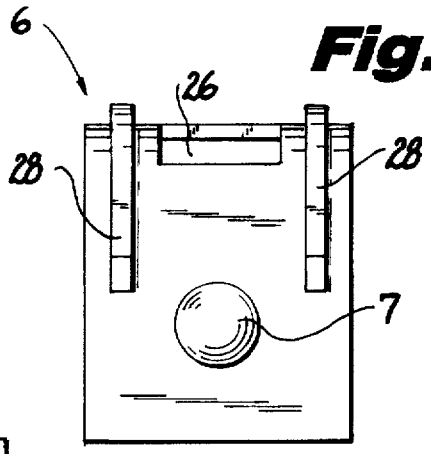
FIG. 15A is a top plan view of the male anchor member portion of the anchor as in FIG. 2.
Figure 15:
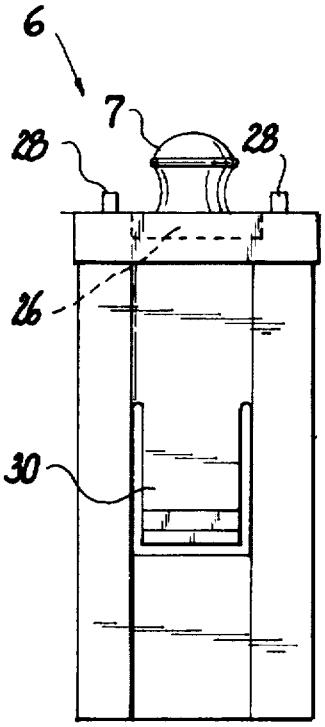
FIG. 15 is a front elevational view of the male anchor member portion of the anchor as in FIG. 2.
Figure 16:
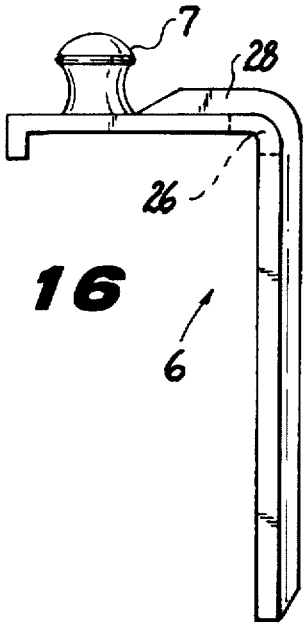
FIG. 16 is a side elevational view of the male anchor member portion of the anchor as in FIG. 2.
Figure 17:
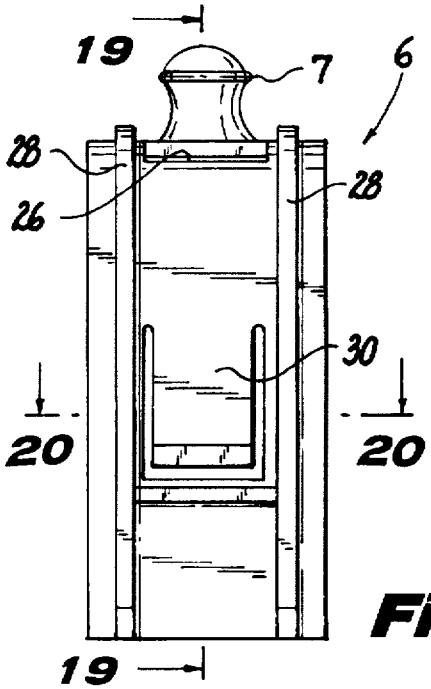
FIG. 17 is a rear elevational view of the male anchor member portion of the anchor as in FIG. 2.
Figure 18:
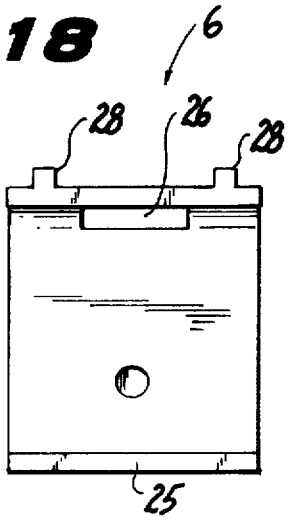
FIG. 18 is a bottom view of the male anchor member portion of the anchor as in FIG. 2.

FIG. 14 is a detail showing the teeth of ratchet rack 19 with their 45 degree tooth angles.

Figure 19:
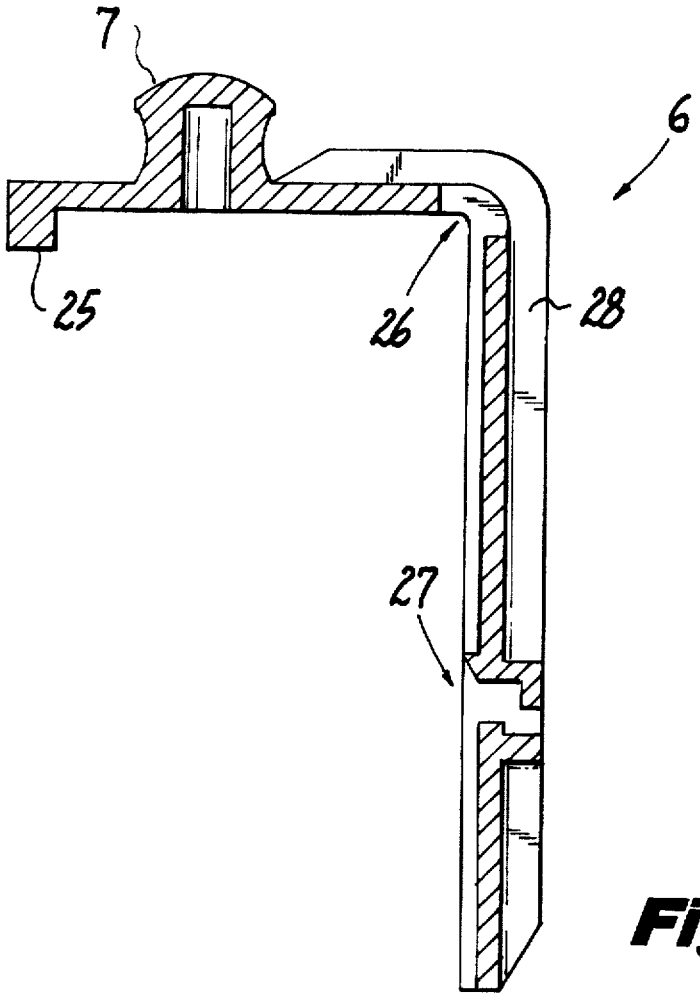
FIG. 19 is a side cross section view of the male anchor member portion of the anchor as in FIG. 2.
Figure 20:
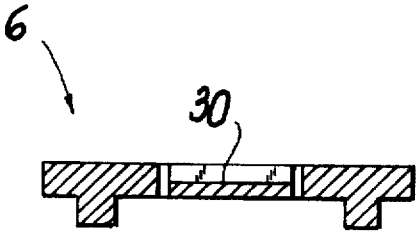
FIG. 20 is a bottom cross section view of the male anchor member portion of the anchor as in FIG. 2.
Figure 21:
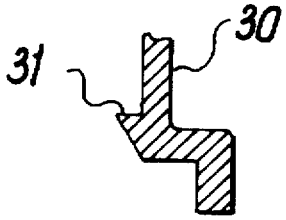
FIG. 21 is a detail of the ratchet snap member portion of the anchor as in FIG. 2.

FIGS. 15 through 20 show a variety of views of the male anchor member including two cross sections. The side view cross section in FIG. 19 shows the integral nature of anchor knob 7. The cross section view of FIG. 20 shows the reduced thickness of tab 30 as compared to the thickness of the adjacent sections; this is necessary to provide a more compliant spring action than would otherwise be available. The ratchet snap detail of FIG. 21 shows engagement edge 31 and screwdriver hole 27.

Figure 23:
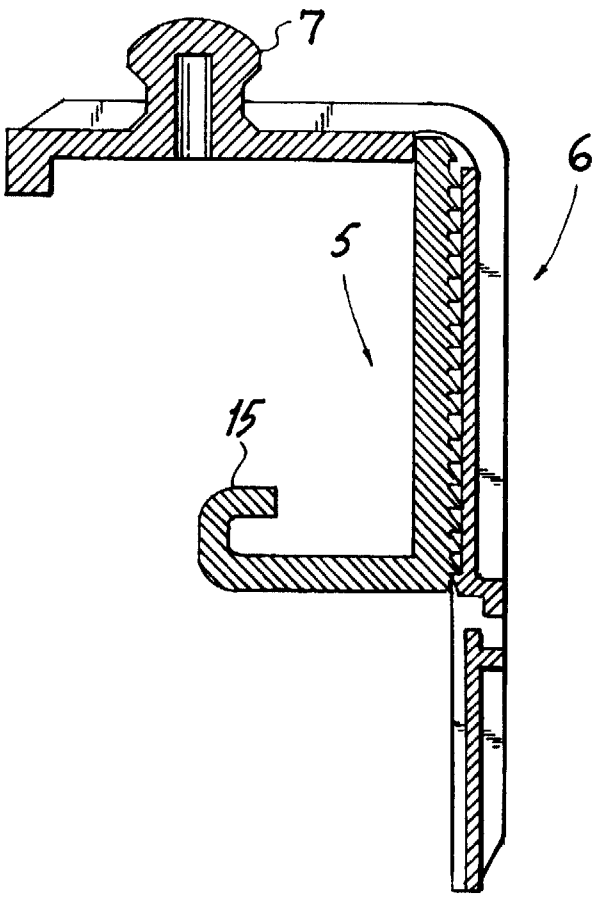
Figure 22:
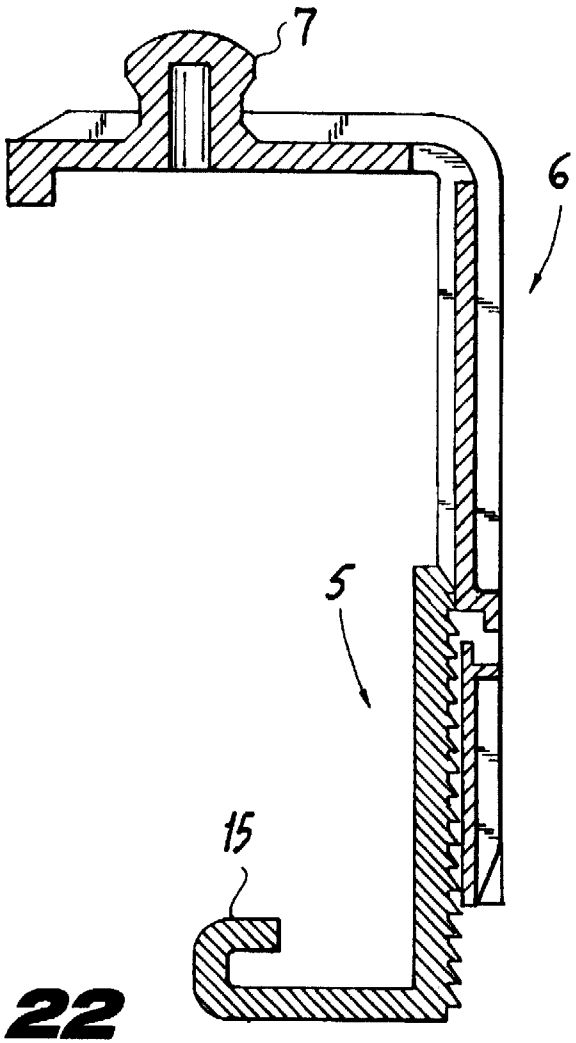
FIG. 22 is a side cross section view in fully extended position of the anchor as in FIG. 2; and, FIG. 23 is a side cross section view in fully retracted position of the anchor as in FIG. 2.

FIG. 22 is a side view cross section of the assembled anchor 4 in the fully extended position. FIG. 23 is a similar view showing the anchor 4 in its fully closed position. This range, from 4.3" to 1.96", accommodates all of the known metal pool frames.

It is known that other modifications may be made to the present invention, without departing from the scope of the invention, as noted in the appended claims.

I claim:

1. A detachable anchor for a swimming pool cover, said anchor engagable with a swimming pool frame by a spring-loaded attachment to the pool cover, said anchor comprising:

a generally C-shaped body having a first member movable relative to a second member, and an anchor knob integral with one member of said first and said second members, said anchor knob engagable with a loop of the spring-loaded attachment, said body of said anchor including an adjustment means permitting said anchor to accommodate a wide variety of pool frame sizes, said adjustment means comprising a retaining member including a plurality of nesting positions for said first member relative to said second member, said retaining member including a plurality of nesting positions comprises a ratchet rack adjustment means including a plurality of teeth comprising a series of step by step adjustment locations, said male anchor member having reinforcing ribs having a male snap tab separately engagable with each tooth of said plurality of teeth comprising said series of step by step adjustment locations of said ratchet rack adjustment means, said snap having an edge movable step by step within said plurality of teeth of said ratchet rack adjustment means, wherein said male anchor member is pushed into said female housing portion for adjustment, said anchor further comprising a hole at a corner of male anchor member permitting an extension of said ratchet rack to move into said hole when adjusting said anchor to a small clamping position.

2. The anchor as in claim 1 wherein said first member comprises a female housing portion and said second member comprises a male anchor member.

3. The anchor as in claim 2 wherein said retaining member including a plurality of nesting positions comprises a ratchet rack adjustment means including a plurality of teeth comprising a series of step by step adjustment locations, said male anchor member having reinforcing ribs having a male snap tab separately engagable with each tooth of said plurality of teeth comprising said series of step by step adjustment locations of said ratchet rack adjustment means, said snap having an edge movable step by step within said plurality of teeth of said ratchet rack adjustment means, wherein said male anchor member is pushed into said female housing portion for adjustment.

4. The anchor as in claim 1 wherein said first member comprises a male anchor member and said second member comprises a female housing portion.

5. The anchor as in claim 4 wherein said anchor knob is integral with said first member.

6. The anchor as in claim 5 wherein said male anchor member slides partially inside said female housing portion.

7. The anchor as in claim 4 wherein said female housing portion further includes a bottom hook member.

8. The anchor as in claim 4 wherein said male anchor member slides partially inside said female housing portion.

9. The anchor as in claim 1 further comprising an opening providing access to a member used to relieve the pressure of said edge of said snap on said ratchet rack to permit said male anchor member to be withdrawn from said female housing portion to facilitate removal of said anchor from the pool frame after a pool cover is removed.

10. A detachable anchor for a swimming pool cover, said anchor engagable with a swimming pool frame by a spring-loaded attachment to the pool cover, said anchor comprising:

a generally C-shaped body having a first member movable relative to a second member, and an anchor knob integral with one member of said first and said second members, said anchor knob engagable with a loop of the spring-loaded attachment, said body of said anchor including an adjustment means permitting said anchor to accommodate a wide variety of pool frame sizes, said adjustment means comprising a retaining member including a plurality of nesting positions for said first member relative to said second member, wherein said first member comprises a female housing portion and said second member comprises a male anchor member, wherein said female housing portion further includes a bottom hook member, wherein said male anchor member slides partially inside said female housing portion, wherein said retaining member including a plurality of nesting positions comprises a ratchet rack adjustment means including a plurality of teeth comprising a series of step by step adjustment locations, said male anchor member having reinforcing ribs having a male snap tab separately engagable with each tooth of said plurality of teeth comprising said series of step by step adjustment locations of said ratchet rack adjustment means, said snap having an edge movable step by step within said plurality of teeth of said ratchet rack adjustment means, wherein said male anchor member is pushed into said female housing portion for adjustment, said anchor having an opening providing access to a member used to relieve the pressure of said edge of said snap on said ratchet rack to permit said male anchor member to be withdrawn from said female housing portion to facilitate removal of said anchor from the pool frame after a pool cover is removed, and, said anchor further having a hole at a corner of said male anchor member permitting an extension of said ratchet rack to move into said hole when adjusting said anchor to a small clamping position.

* * * * *